United States Patent [19]

Strauss et al.

[11] Patent Number: 5,008,490

[45] Date of Patent: Apr. 16, 1991

[54] STRIPPABLE ELECTRICALLY SHIELDED CABLE

[75] Inventors: Richard F. Strauss, Morrisville, Pa.; Richard A. Fiacco, Bayville, N.J.; Hosrow T. Bordbar, Stanton, Calif.; Caesar C. Chen, Fountain Valley, Calif.; David Quiroz, Santa Ana, Calif.

[73] Assignee: Thomas & Betts Corporation, Bridgewater, N.J.

[21] Appl. No.: 467,698

[22] Filed: Jan. 19, 1990

[51] Int. Cl.[5] ..... H01B 7/08

[52] U.S. Cl. ..... 174/36; 174/115; 174/117 F; 174/117 A

[58] Field of Search ..... 174/36, 115, 117 F, 174/117 A

[56] References Cited

U.S. PATENT DOCUMENTS

| | | | |
|---|---|---|---|
| 3,311,696 | 3/1967 | Melnick | 174/18 |
| 3,700,825 | 10/1972 | Taplin et al. | 174/36 |
| 3,757,029 | 9/1973 | Marshall | 174/36 |
| 4,264,384 | 4/1981 | Karanastassis | 156/49 |
| 4,327,246 | 4/1982 | Kincaid | 174/36 |
| 4,513,170 | 4/1985 | Apodaca | 174/36 |
| 4,596,897 | 6/1986 | Gruhn | 174/36 |
| 4,652,772 | 3/1987 | Shephard | 174/117 F X |
| 4,678,864 | 7/1987 | Cox | 174/36 |
| 4,698,457 | 10/1987 | Bordbar | 174/36 |

FOREIGN PATENT DOCUMENTS 3306493 1/1983 Fed. Rep. of Germany .

*Primary Examiner*—Morris H. Nimmo

*Attorney, Agent, or Firm*—Robert M. Rodrick; Salvatore J. Abbruzzese

[57] ABSTRACT

A strippable, shielded electrical cable comprises a plurality of elongate, parallel-spaced electrical conductors encased in a casing of electrical insulation. At least one of the conductors, preferably located at a position other than at the marginal ends of the cable has an exposed portion free of casing material. An electrically conductive wire mesh shield overlies the casing and is in electrical contact with the exposed conductor portions. A top layer of electrical insulation overlies the wire mesh shield. A release sheet of electrical insulation is disposed between the conductive shield and the cover layer. A first adhesive is on the lower surface of the sheet facing the shield, the first adhesive being removably adhered to the metallic wire mesh shield. The first adhesive and a portion of the casing material are removably adhered to each other through the interstitial openings of the wire mesh. A second adhesive is disposed on the opposing surface of the release sheet facing the layer, the second adhesive being removably adhered to the cover layer.

9 Claims, 1 Drawing Sheet

STRIPPABLE ELECTRICALLY SHIELDED CABLE

FIELD OF THE INVENTION

This invention relates to multiconductor electrical cable and more particularly, to an improved strippable, shielded electrical cable.

BACKGROUND OF THE INVENTION

Flat, multiconductor flexible cable has come into extensive commercial use. Such cable generally comprises a ribbon of insulative material encasing a plurality of round or thin flat conductors disposed in spaced, parallel relation. In many applications, these conductors are electrically shielded to reduce cross-talk, and to reduce electromagnetic interference (EMI) and radio frequency interference (RFI). One or more of the spaced parallel conductors may be in engagement with the ground shield for use as ground conductors in the electrical cable. In order to mass terminate the conductors of the electrical cable, it is necessary to strip away the outer jacket of the cable and the ground shield so that a mass termination connection may be applied to the enclosed conductors.

Strippable, shielded electrical cables for mass termination are known. One example is shown in U.S. Pat. No. 4,513,170, issued Apr. 23, 1985 and assigned to the same Assignee as the present invention. In this prior strippable shielded electrical cable, a release sheet is disposed between the insulative casing that surrounds the conductors and a wire mesh ground shield. A plurality of apertures is placed in and along the release sheet to enable the insulative casing to lightly bond to the outer cover through the wire mesh ground shield. While this cable assembly provides for ready stripping, it has been observed that where the areas of insulation are bonded through the apertures in the release sheet, the cable assembly exhibits some bubbling or separation therebetween.

In an effort to overcome this difficulty, a strippable, shielded electrical cable as shown in U.S. Pat. No. 4,698,457, issued Oct. 6, 1987 and assigned to the same Assignee as the subject invention, has been developed. In this cable, and similar to that shown in the '170 patent, a release sheet is disposed between the casing surrounding the electrical conductors and the wire mesh ground shield. However, in the '457 cable, the apertures have been removed from the release sheet and instead a coating of adhesive is disposed on the upper surface of the release sheet, the adhesive being bonding through the wire mesh to the outer cover of the cable. The lower surface of the release sheet includes a release agent thereon by which there is little or no bonding between the release sheet and the insulative casing. Again, while this construction facilitates stripping, it has been found that the ground shield tends to separate from the casing during bending or rolling operations which subsequently causes difficulty with laying the cable flat during use.

A further example of a known strippable electrical cable is shown in U.S. Pat. No. 4,678,864, issued on July 7, 1987. In this cable, a metallic mesh ground shield is positioned between the main cable and the insulative covering. Portions of the lower surface of the insulative covering are coated by a release agent and other portions of that surface are uncoated. Accordingly, upon application of heat and pressure the insulative covering is bonded to the insulation of the main cable at the uncoated portions in a manner to minimize adhesion and facilitate separation of the main cable from the ground plane.

In addition to the desirability of providing an electrical cable that is readily strippable and yet maintains its structural integrity during handling and use, it has also become desirable to locate the ground conductors or drain wires in any position in the cable. For example, in the '170 cable and the '457 cable constructions, the drain wires are shown as being located at the marginal edges of the cable. Such location helps to facilitate stripability by the use of non-adherent insulative strips located at the marginal edges of the cable. In the '864 cable, the drain wire is also shown as being at the marginal edge of the cable. Accordingly, provision of a strippable, electrical cable wherein the drain wire is disposed at any location throughout the cable is desirable.

SUMMARY OF THE INVENTION

It is an object of the present invention to provide a strippable, shielded electrical cable.

It is a further object of the present invention to provide a strippable, shielded electrical cable wherein the ground conductor is located at a position other than at the marginal edge of the cable.

In accordance with a preferred form of the invention, a strippable, shielded electrical cable comprises a plurality of elongate, spaced electrical conductors enclosed in a casing of electrically insulative material. At least one of such conductors has an exposed portion free of the casing material. An electrically conductive shield of permeable material overlies the casing and is in electrical contact with the exposed conductor portion. A layer of electrical insulation overlies the conductive shield. A sheet of electrical insulation is disposed between the conductive shield and the layer and a first adhesive is disposed on one surface of the sheet facing the shield. The first adhesive is removably adhered to the shield, such first adhesive and the casing being removably adhered to each other through the permeable material. A second adhesive is disposed on the opposite surface of the sheet facing the layer. The second adhesive is removably adhered to such layer.

In accordance with a preferred form of the invention, at least one conductor having such exposed portion free of casing material is disposed laterally interiorly of at least one other conductor. Further, it is preferred that plural such conductors having such exposed portions be provided.

DETAILED DESCRIPTION OF THE PREFERRED EMBODIMENTS

Figure 1:
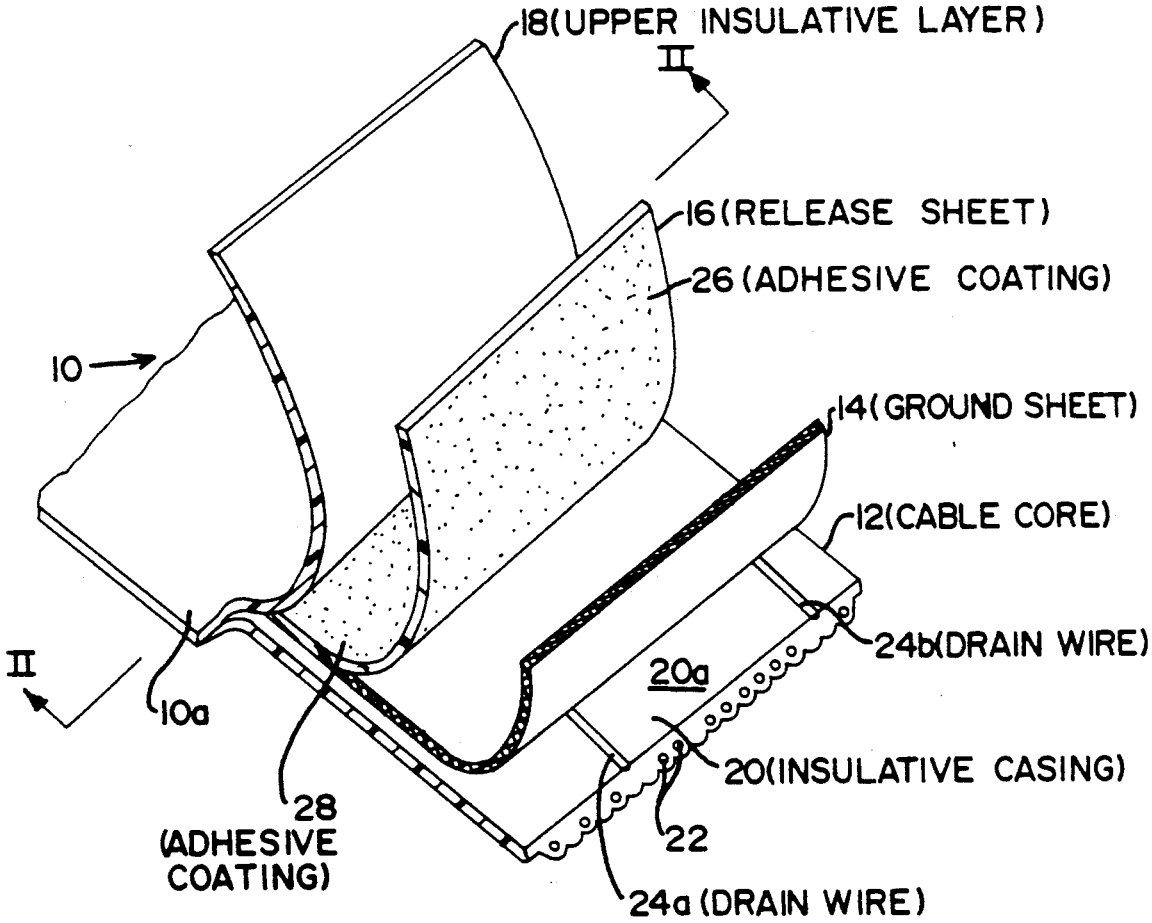
FIG. 1 is a perspective view showing a strippable, shielded, multiconductor cable of the present invention with various layers thereof being illustrated in a stripped position.
Figure 2:
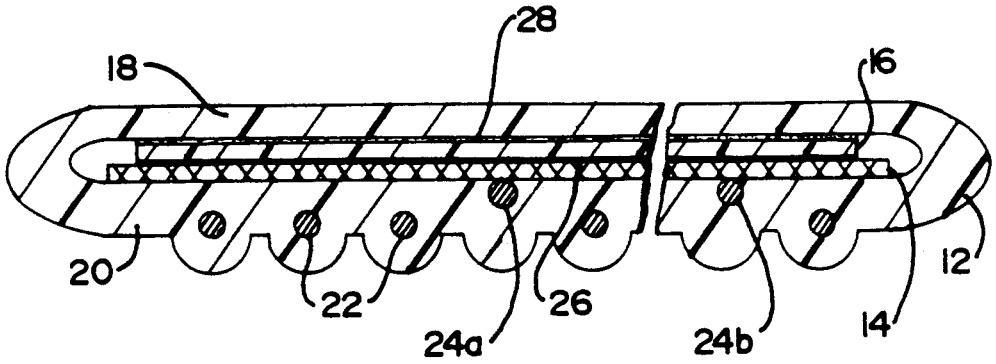
FIG. 2 is a sectional view as seen along line II—II of FIG. 1.

Referring now to FIGS. 1 and 2, there is shown in accordance with a preferred embodiment of the invention, a strippable, shielded, multiconductor flat electrical cable, generally designated as 10. The cable 10 comprises a multiconductor cable core 12, a conductive ground shield 14, a release sheet 16 and an upper insulative layer 18. The cable core is of conventional ribbonlike construction including a generally flat elongate casing 20 of thermoplastic rubber (TPR), polyvinylchloride (PVC) or other suitable insulative material enclosing a plurality of elongate, parallel-spaced conductors 22. Embedded in the upper casing surface 20*a* and extending longitudinally parallel with the conductors 22 are drain wires 24*a* and 24*b*, the upper longitudinal extents of which are exposed for contact with the ground shield 14, as will be described.

The ground shield 14, preferably a sheet of metallic wire mesh or other permeable conductive material, is generally elongate having a transverse extent extending beyond the width of the conductors 22. As such, the ground shield overlies all the cable core conductors 22 and the drain wires 24*a* and 24*b*.

The upper layer 18 is preferably formed of thermoplastic rubber (TPR) or polyvinylchloride (PVC), although other suitable insulative materials may be used.

The release sheet 16 comprises a sheet of polyester, such as Mylar (registered trademark of duPont) or other suitable material and extends widthwise nearly across the entire width of the cable core 12. The release sheet 16 in the preferred form has a thickness of approximately 0.002 inch. On the lower surface of the release sheet 16, that is, the surface facing the ground shield 14, there is disposed a coating of adhesive 26. Adhesive 26 is of the type that is particularly adherent to metal and, as such, is adherent to the upper surface of the metallic mesh ground shield 14. Preferably adhesive 26 is an acrylic adhesive on the order of 0.002 inch thick. On the opposite surface of the release sheet, namely the surface facing the upper insulative layer 18, there is disposed thereon a second coating of adhesive 28. Adhesive 28 is of the type that is particularly adherent to insulation and, as such, is adherent to the lower surface of the insulative layer 18. Adhesive 28 is preferably an ethylene acrylicacid copolymer adhesive on the order of 0.0002 inch thick.

The cable 10 is fabricated by arranging the components herein described in the orientation and disposition illustrated and extruding same to produce the final cable assembly. It should be appreciated that other suitable processing techniques, such as lamination, may also be employed. During fabrication, the extrusion takes place at a time and temperature to exceed the melting points of the casing 20 material, the upper layer 18 material and the adhesives 26 and 28, but to not exceed the melting point of the release sheet 16. Accordingly, as shown in FIG. 2, the outer lateral marginal portions of the upper layer 18 and the casing 20 are bondably joined in a manner that forms a substantially unitary assembly.

During the extrusion process, the adhesive 26 and the insulative material of the casing 20 flow into the interstitial openings of the wire mesh ground shield 14. This flow of material into the interstitial openings serves to lightly bond the wire mesh ground shield to the casing 20. The release sheet 16 further prevents flow of insulative material from the upper layer 18 and the insulative material from the casing 20 from joining during the extrusion process, except at the marginal edges of the cable. Moreover, during the extrusion process, the adhesives 26 and 28 effectively retain their adhesive properties whereby the release sheet is secured to the upper layer 18 by adhesive 28 and the release sheet 16 is adhesively secured to the wire mesh ground shield 14 by adhesive 26.

In accordance with the invention, the drain wires may be placed at any location amongst the cable conductors 22. In the preferred form, plural drain wires are provided, each of such drain wires 24*a* and 24*b* being located interiorly of the conductors 22 at the marginal edges. It should be appreciated, however, that any number of drain wires may be used and such drain wires may be disposed at any location throughout the width of the cable 10.

With reference to FIG. 1, stripping of the cable is effected by first removing, as by cutting, both lateral margins 10A of the cable. The cable core 12 is readily stripped from the lower surface of the wire mesh ground shield 14 which is lightly attached thereto by the adhesive 26 and casing material being in the interstitial openings of the wire mesh 14. Due to such light attachment, the drain wires 24*a* and 24*b* are not pulled out from the casing 20, but rather remain affixed to the casing 20. The wire mesh is strippable from the lower surface of the release sheet 16 by breaking the light bond provided by the adhesive 26. Similarly, the upper insulative layer 18 is readily separated from the release sheet by breaking the light bond provided by the adhesive 28. As such, mass termination may be effected to the conductors 22 in the cable core 12 and separate terminations may be made to the ground shield 14.. In addition to the ready strippability of the cable 10 of the subject invention, it has been found that the use of the adhesives on the release sheet provides a stable structural assembly which maintains its integrity during handling and lies flat in use. Further, the construction of the subject cable provides for flexibility in design in the ability to locate drain wires, or ground conductors at any location throughout the width of the cable 10, in electrical contact with the ground shield 14.

Having described the preferred embodiment of the invention herein, it should be appreciated that other variations may be apparent to one skilled in the art without departing from the contemplated scope of the invention. Thus, the particularly described preferred embodiment is intended to be illustrative and not limited to the preferred embodiment. The true scope of the invention is set forth in the following claims.

I claim:

1. A strippable, shielded electrical cable comprising:

a plurality of elongate, spaced electrical conductors;

a casing of electrically insulative material enclosing said conductors, at least one of said conductors having an exposed portion free of said casing material;

an electrically conductive shield of permeable material overlying said casing and in electrical contact with said exposed conductor portion;

a layer of electrical insulation overlying said conductive shield; and a sheet of electrical insulation disposed between said conductive shield and said layer, a first adhesive on one surface of said sheet facing said shield, said first adhesive being removably adhered to said shield, said first adhesive and said casing being removably adhered to each other through said permeable material, a second adhesive on an opposing surface of said sheet facing said layer, said second adhesive being removably adhered to said layer.

2. A strippable, shielded electrical cable according to claim 1, wherein there are plural conductors having an exposed portion.

3. A strippable, shielded electrical cable according to claim 2, wherein said casing is elongate and generally flat, said conductors being disposed in substantially parallel relation therein, said plural conductors having such exposed portions each being disposed transversely interiorly of at least one other conductor.

4. A strippable, shielded electrical cable according to claim 1, wherein said casing and said layer are elongate, each having a width extending beyond the width of said shield and said sheet, marginal edges of said casing and layer being non-removably joined to each other.

5. A strippable, shielded electrical cable according to claim 4, wherein said layer and said casing are joined by extrusion and wherein a portion of said casing extends into the permeable material, whereby said shield and said casing are attached in light, removable adherence.

6. A strippable, shielded electrical cable according to claim 1 wherein said first adhesive and said second adhesive comprise different adhesives.

7. A strippable, shielded electrical cable according to claim 6, wherein said conductive shield comprises metallic wire mesh.

8. A strippable, shielded electrical cable according to claim 7, wherein said first adhesive is of the type adherable to metal, and wherein said first adhesive is in adherence with a surface of said metallic wire mesh.

9. A strippable, shielded electrical cable according to claim 8, wherein said second adhesive is of the type adherable to insulation, and wherein said second adhesive is in adherence with a surface of said insulative layer.

* * * * *